US005240141A

United States Patent [19]

Blette

[11] Patent Number: 5,240,141

[45] Date of Patent: Aug. 31, 1993

[54] HAND-HELD DISPENSER WITH PIVOTAL COVER FOR COLLAPSIBLE TUBES

[75] Inventor: Russell E. Blette, Hastings, Minn.

[73] Assignee: Minnesota Mining and Manufacturing Company, St. Paul, Minn.

[21] Appl. No.: 903,369

[22] Filed: Jun. 24, 1992

[51] Int. Cl.[5] ..... B65D 35/28

[52] U.S. Cl. ..... 222/95; 222/146.5; 219/227; 219/533

[58] Field of Search ..... 222/95, 94, 146.5, 389, 222/397; 219/227, 243, 528, 533, 545; 156/579

[56] References Cited

U.S. PATENT DOCUMENTS

| | | | |
|---|---|---|---|
| 1,555,711 | 9/1925 | Hershinger . | |
| 1,709,445 | 4/1929 | Tomes . | |
| 3,281,576 | 10/1966 | Cooper et al. | 219/227 X |
| 3,767,085 | 10/1973 | Cannon et al. | 222/82 |
| 3,831,815 | 8/1974 | Glasgow | 222/146.5 |
| 3,871,553 | 3/1975 | Steinberg | 222/95 |
| 3,873,003 | 3/1975 | Seiferth et al. | 222/95 |
| 3,938,706 | 2/1976 | Cohen | 222/83.5 |
| 3,938,709 | 2/1976 | Collar | 222/95 |
| 3,976,223 | 8/1976 | Jass et al. | 222/94 |
| 3,985,268 | 10/1976 | Wood | 222/108 |
| 4,067,481 | 1/1978 | Feldman | 222/146.5 |
| 4,090,514 | 5/1978 | Hinck et al. | 128/214 F |
| 4,098,434 | 7/1978 | Uhlig | 222/94 |
| 4,208,571 | 6/1980 | Moumaneix et al. | 219/533 X |
| 4,264,018 | 4/1981 | Warren | 222/95 |
| 4,379,453 | 4/1983 | Baron | 604/145 |
| 4,507,116 | 3/1985 | Leibinsohn | 604/142 |
| 4,539,005 | 9/1985 | Greenblatt | 222/95 X |
| 4,708,938 | 11/1987 | Hickinbotham | 435/311 |
| 4,796,788 | 1/1989 | Bond | 222/94 |
| 4,857,055 | 8/1989 | Wang | 604/133 |
| 4,974,752 | 12/1990 | Sirek | 222/146.5 |

*Primary Examiner*—Gregory L. Huson

*Attorney, Agent, or Firm*—Gary L. Griswold; Walter N. Kirn; James D. Christoff

[57] ABSTRACT

A dispenser for dispensing material from a collapsible tube includes a housing and a cover connected to the housing by pins that enable movement of the cover in an arc toward and away from the housing in clamshell-like fashion. An inflatable bladder is received in a recess of the housing and, when inflated, bears against the tube for collapsing the tube and directing material in the tube toward an application site.

12 Claims, 2 Drawing Sheets

HAND-HELD DISPENSER WITH PIVOTAL COVER FOR COLLAPSIBLE TUBES

BACKGROUND OF THE INVENTION

1. Field of the Invention

This invention relates to a hand-held dispenser for dispensing liquid or semi-liquid material from a collapsible tube.

2. Description of the Related Art

Collapsible tubes are widely known by the public for use as containers for toothpaste and household adhesives. Collapsible tubes are also popular containers for caulk, sealants and other liquid or semi-liquid materials used in construction, vehicle manufacturing and other industries. Collapsible tubes are favored as containers for many materials such as "instant-setting" adhesives because the tube is relatively inexpensive and provides a better initial seal from the atmosphere than, for example, caulking-gun type containers. Once the tube is emptied, the tube can be conveniently disposed of without clean-up as might be necessary with other dispensing systems where the material is transferred from a bulk container to a second container for dispensing.

Hand-held dispensers for collapsible tubes have sometimes used controlled air pressure within a housing containing the tube in order to squeeze the tube and dispense material to a desired location. Examples of hand-held pressurized air dispensers for collapsible tubes are shown for example in U.S. Pat. Nos. 3,871,553 and 3,938,709, both of which illustrate a dispenser having an internal chamber, a rear opening for admitting a tube into the chamber, and a somewhat smaller front opening for receiving a nozzle of the collapsible tube. In the devices shown in the above-mentioned patents, the operator controls the pressure of air in the chamber so that collapsing of the tube is regulated to some degree.

However, air is compressible, and it is sometimes difficult to control the air pressure in a chamber in order to squeeze a tube in such a fashion that only a certain amount of material at a desired flow rate is extruded from the tube. Another problem that may occur is known as run-on, where material dribbles or oozes from the nozzle after an intended end of a dispensing operation, a particular problem when the tube is made of a material that does not have significant shape memory. Problems of imprecise control and run-on are a significant nuisance with workpieces such as small electronic circuit boards where little space is available to hold excess material.

SUMMARY OF THE INVENTION

The present invention is directed toward a dispenser for dispensing material from a collapsible tube, and includes a housing and a cover movable in a certain direction toward a closed position next to the housing. The housing and the cover define a chamber when the cover is in the closed position for receiving a collapsible tube. The chamber has a longitudinal axis generally perpendicular to the certain direction of movement of the cover toward the closed position. A latch is provided for releasably retaining the cover in a closed position next to the housing. An inflatable bladder is located in the chamber, and the bladder during inflation is operable to at least partially collapse the tube for dispensing material.

The bladder during inflation provides equal pressure to the tube over the entire area of the bladder, yet eliminates the necessity of sealing the chamber with gaskets or the like, such that construction of the dispenser is simplified. Moreover, the inflatable bladder provides relatively precise control over the amount of material being dispensed and termination of the dispensing operation so that an undue run-on is avoided. Movement of the cover in a direction perpendicular to the longitudinal axis of the chamber provides good access to the chamber for removal or insertion of a tube when necessary.

DETAILED DESCRIPTION OF THE PREFERRED EMBODIMENT

Figure 1:
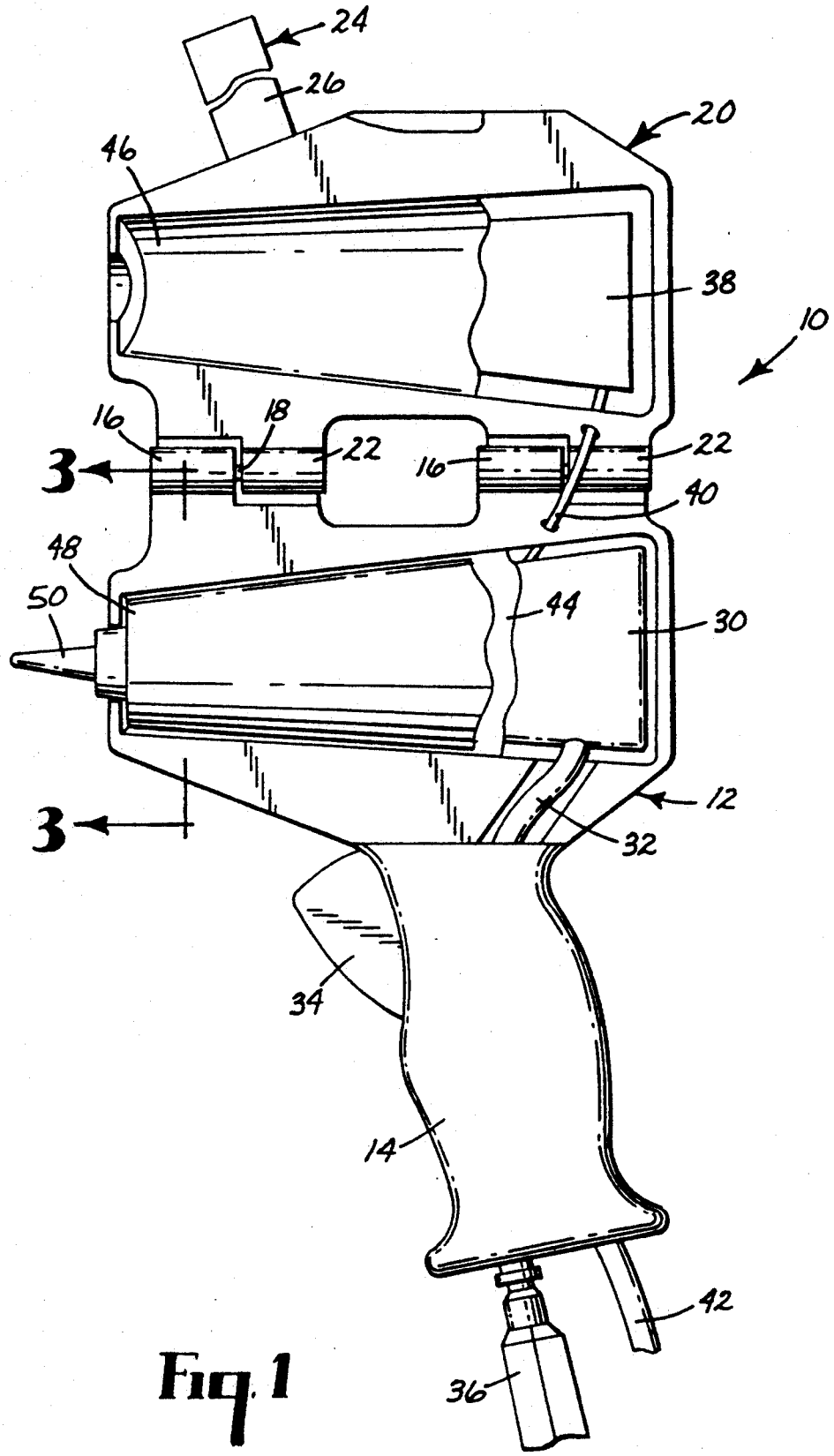
FIG. 1 is a side elevational view of a dispenser according to the invention, wherein a cover of the dispenser has been moved to an open position to enable insertion or removal of a tube, with the tube and parts of the dispenser broken away for clarity.
Figure 2:
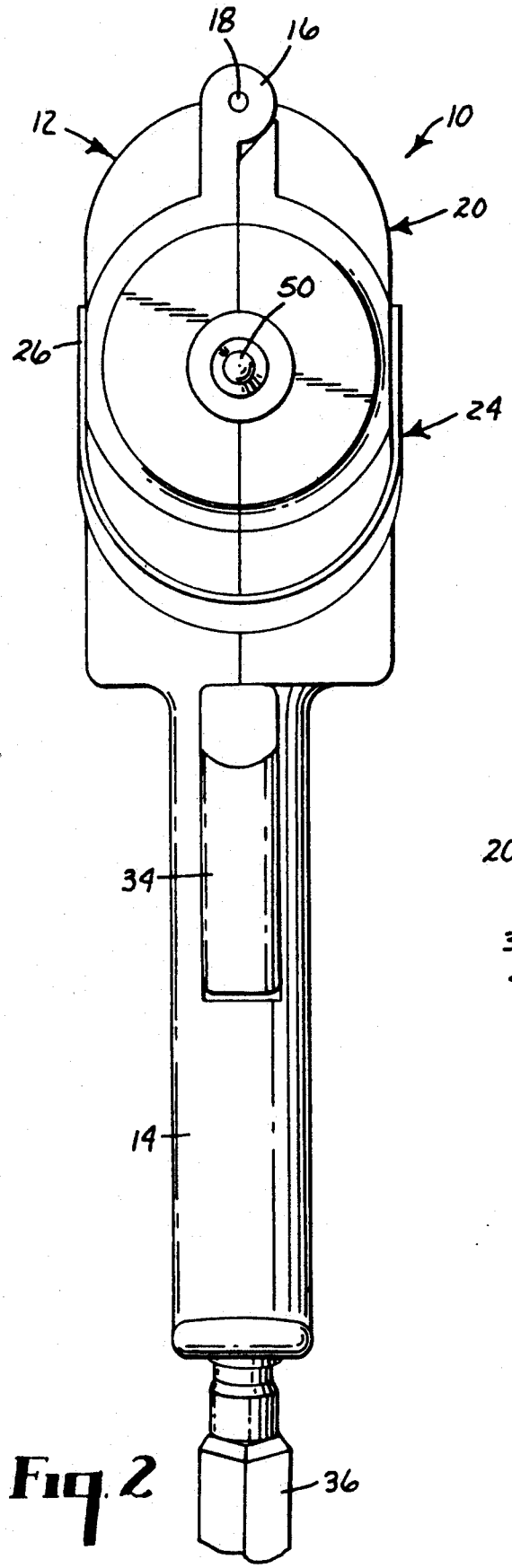
FIG. 2 is an enlarged front elevational view of the dispenser shown in FIG. 1, except that the cover has been moved toward a closed position.
Figure 3:
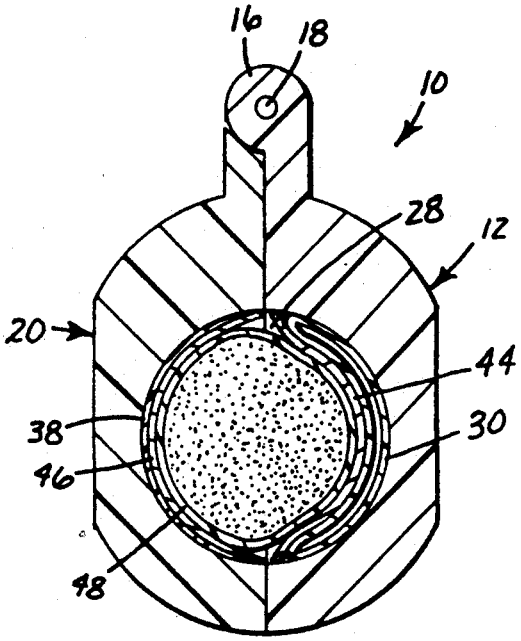
FIG. 3 is an enlarged cross-sectional view of the dispenser and collapsible tube taken along lines 3—3 of FIG. 1, except that the cover of the dispenser is shown in its closed position.

A dispenser 10 for dispensing material from a collapsible tube is shown in FIGS. 1–3 and includes a housing 12 integrally connected to a depending, contoured handle 14 that has a configuration adapted for grasping by the operator. The top of the housing 12 includes a pair of aligned, spaced apart tabs 16 that each receive a pin 18 in force-fit relation.

The dispenser 10 also includes a cover 20. As illustrated in the drawings, the cover 20 has an aligned, spaced apart pair of tabs 22, each of which has a central bore that receives a respective pin 18. The pins 18 function as a pivot means for enabling the cover 20 to move relative to the housing 12 in an arc about the longitudinal axis of the pins 18.

The cover 12 is movable from an open position as shown in FIG. 1 to a closed position as shown in FIGS. 2 and 3. A latch 24 for retaining the cover 12 in its closed position comprises a flexible, elongated strap 26 with a free end and an opposite end fixed to an outer side of the cover 12. The free end of the strap 26 has a hook fastener structure that releasably latches with a section of loop fastener structure affixed to the housing 12.

The cover 20 and the housing 12 each have an internal recess of somewhat equivalent configuration, and the recesses define a chamber 28 as illustrated in FIG. 3 when the cover 20 is in its closed position. The chamber 28 has a somewhat frustoconical shape and a central longitudinal axis that is parallel to the aligned longitudinal axes of the pins 18, so that the cover 20 when moved toward its closed position follows an arcuate path that lies in a plane perpendicular to the longitudinal axis of the chamber 28. As such, the cover 20 is laterally movable relative to the housing 12 in directions perpendicular to the longitudinal axis of the chamber 28, to facilitate access to the chamber 28 when desired.

An inflatable bladder 30 is received in the recess of the housing 12 and comprises a unitary bag-like structure made of a flexible material such as synthetic rubber. The bladder 30 communicates via tubing 32 with a normally off trigger-style air valve 34 that, when depressed, admits air into the bladder 30 from a detachable tube 36 connected to a source of pressurized air.

The recess of the cover 20 receives a flexible mat heater 38 having embedded electrical resistance heating elements. The mat heater 38 has an area substantially equal to the area of the recess, and thus extends across substantially all of one side of the chamber 28. The heater 38 is electrically coupled via a lead 40 to a switch (not shown) mounted on the handle 14. The switch in turn is connected by a cord 42 to a source of electrical power.

As shown in FIGS. 1 and 3, a thin flexible liner 44 coupled to the housing 12 covers the inflatable bladder 30, and a similar liner 46 connected to the cover 20 covers the heater 38. The liners 44, 46 surround the chamber 28 and engage opposite sides of a collapsible tube 48 containing a quantity of material to be dispensed. As can be appreciated by reference to, for example, FIGS. 1 and 3, the chamber 28 and the bladder 30 have a configuration adapted to support the tube 48 when the bladder 30 is not inflated.

The tube 48 has a front nozzle 50 that protrudes through a forward opening in the dispenser 10. The forward opening is next to the chamber 28 and is formed when the cover 20 is closed by a semicircular hole in the front end of the cover 20 and a similar, adjacent hole in the front end of the housing 12. Before a dispensing operation is initiated, a front, sealed tip of the nozzle 50 is severed or otherwise opened to enable material in the tube 48 to be dispensed directly to an application site. Preferably, the body of the tube 48 is integrally made of a material such as aluminum that has significant shape memory, so that any adhesive or other material being dispensed that remains near the nozzle 50 after the end of a dispensing operation is drawn back into the tube 48 and run-on is avoided.

In use, the dispenser 10 is first opened by releasing the strap 26 from the housing 12 and pivoting the cover 20 in an arc about the pins 18 away from the housing 12. Next, the tube 48 is moved laterally, or in a direction perpendicular to its longitudinal axis, into the recess of the housing 12 such that the nozzle 50 protrudes through the front hole of the housing 12 as shown in FIG. 1. The cover 20 is then moved in an arc about the pins 18 toward its closed position as shown in FIGS. 2 and 3, and the hook fastener structure of the strap 26 is latched to the loop fastener structure to retain the cover 20 in place. Advantageously, the hook and loop latch 24 provides some degree of choice of latching positions, so that if the tube 48 is slightly larger than the chamber 28 the strap 26 can still function to releasably retain the cover 20 in a fixed position.

Next, after opening the tip of the nozzle 50, the air valve 34 is depressed to admit air into the bladder 30. As the bladder 30 inflates, the bladder 30 urges the adjacent side of the tube 48 toward its opposite side (which is rendered immovable by the portion of the cover 20 behind the heater 38), and as the tube 48 collapses, material within the tube 48 is extruded through the nozzle 50 to a workpiece. The air valve 34 includes a valve mechanism to dump downstream pressurized air, so that when the operator's finger pressure is released from the air valve 34, air pressure in the tubing 32 as well as the bladder 30 is immediately relieved to facilitate rapid release of pressure on the tube 48 and avoid undue run-on.

Dispensing of certain materials is facilitated when the material is warmed. In such instances, the tube 48 is warmed by a preheater (not shown) and the heater 38 is activated so that the temperature of the tube 48 remains elevated during the time that the tube 48 is in the chamber 28. Alternatively, if sufficient time is available, heater 38 is used to bring the temperature of the tube 48 to a desired value.

The dispenser 10 is advantageous because the clamshell movement of the cover 20 relative to the housing 12 facilitates access to the chamber 28 for insertion or removal of the tube 48. Moreover, the self-contained inflatable bladder 38 obviates the need to pressurize the entire space surrounding the tube 36 such that gaskets and the like surrounding the tube 36 and the chamber 28 are rendered unnecessary. If desired, a second bladder may be provided in the space occupied by the heater 38, and other means (such as heating coils between the bladders and the liners 44, 46) may be used to retain the temperature of the tube 48 elevated above atmospheric.

I claim:

1. A dispenser for dispensing material from a collapsible tube comprising:

a housing having a depending handle and an air valve connected to said housing next to the handle;

a cover movable in a certain direction toward a closed position next to said housing, said housing an said over defining a chamber when said cover is in said closed position for receiving the collapsible tube, said chamber having a longitudinal axis generally perpendicular to said certain direction of movement of said cover toward said closed position;

a latch for releasably retaining said cover in a closed position next to said housing; and an inflatable bladder located next to said chamber and connected to said air valve, said air valve controlling the admission of air into said bladder, said bladder during inflation being operable to at least partially collapse the tube for dispensing material, said chamber and said bladder having a configuration adapted to support the tube when said bladder is not inflated.

2. The dispenser of claim 1; including pivot means connecting said cover to said housing for movement of said cover in an arc toward said closed position.

3. The dispenser of claim 2, wherein said arc extends in a plane substantially perpendicular to said longitudinal axis of said chamber.

4. The dispenser of claim 1, wherein said bladder is secured to said housing.

5. The dispenser of claim 1, wherein said cover includes a heater.

6. The dispenser of claim 1; and including a flexible liner between said bladder and said chamber when said cover is in said closed position.

7. The dispenser of claim 1, wherein said bladder extends along the substantial extent of the length of said chamber.

8. The dispenser of claim 1; including a source of pressurized air connected to said air valve.

9. The dispenser of claim 1, wherein said bladder comprises a unitary bag-like structure made of a flexible material.

10. The dispenser of claim 1; including a heater having electrical resistance elements next to said chamber.

11. The dispenser of claim 10, wherein said heater is a flexible mat having embedded electrical resistance elements.

12. The dispenser of claim 1, wherein said latch is operable to releasably retain said cover in any one of a number of fixed positions next to said housing.

* * * * *

UNITED STATES PATENT AND TRADEMARK OFFICE

CERTIFICATE OF CORRECTION

PATENT NO. : 5,240,141

DATED : August 31, 1993

INVENTOR(S) : Russell E. Blette

It is certified that error appears in the above-identified patent and that said Letters Patent is hereby corrected as shown below:

Col. 4, line 24, "an" should be -- and -- and "over" should be -- cover --.

Signed and Sealed this

Twenty-third Day of August, 1994

*Attest:*

*Attesting Officer*

BRUCE LEHMAN

*Commissioner of Patents and Trademarks*